United States Patent [19]

Suzuki et al.

[11] Patent Number: 4,890,527

[45] Date of Patent: Jan. 2, 1990

[54] MIXING TYPE TONE SIGNAL GENERATION DEVICE EMPLOYING TWO CHANNELS GENERATING TONES BASED UPON DIFFERENT PARAMETER

[75] Inventors: Hideo Suzuki; Yasushi Kurakake, both of Hamamatsu, Japan

[73] Assignee: Yamaha Corporation, Hamamatsu, Japan

[21] Appl. No.: 19,024

[22] Filed: Feb. 26, 1987

[30] Foreign Application Priority Data

Feb. 28, 1986 [JP] Japan ..... 61-43036

[51] Int. Cl.[4] ..... G10H 1/08; G10H 7/00

[52] U.S. Cl. ..... 84/697; 84/625; 84/660

[58] Field of Search ..... 84/1.01, 1.19–1.23, 84/1.11, 1.12, 1.28, 1.1

[56] References Cited

U.S. PATENT DOCUMENTS

| | | | |
|---|---|---|---|
| 4,231,276 | 11/1980 | Ardo et al. | 84/1.19 |
| 4,246,823 | 1/1981 | Wachi et al. | 84/1.22 |
| 4,383,462 | 5/1983 | Nagai et al. | 84/1.01 X |
| 4,437,379 | 3/1984 | Okumura | 84/1.01 X |
| 4,536,853 | 8/1985 | Kawamoto et al. | 84/1.01 X |
| 4,552,051 | 11/1985 | Takeuchi | 84/1.1 X |
| 4,558,623 | 12/1985 | Buchla | 84/1.1 |
| 4,633,749 | 1/1987 | Fujimori et al. | 84/1.01 |
| 4,646,612 | 3/1987 | Suzuki | 84/1.22 |
| 4,679,480 | 7/1987 | Suzuki | 84/1.1 X |
| 4,699,037 | 10/1987 | Minamitaka et al. | 84/1.1 |
| 4,713,996 | 12/1987 | Oguri | 84/1.22 X |
| 4,719,833 | 1/1988 | Katoh et al. | 84/1.28 X |
| 4,738,179 | 4/1988 | Hideo | 84/1.19 |
| 4,779,505 | 10/1988 | Suzuki | 84/1.1 X |

*Primary Examiner*—Stanley J. Witkowski

*Attorney, Agent, or Firm*—Spensley Horn Jubas & Lubitz

[57] ABSTRACT

There are provided first and second tone signal generation channels for respectively generating tone signals having waveshape characteristics corresponding to parameters assigned thereto. Tone color change control information such as key touch data is applied to a parameter assigning circuit. The parameter assigning circuit selects two parameters from among three or more parameters which are different from one another and assigns the selected two parameters to the first and second tone signal generation channels respectively. Tone signals having different characteristics, which are determined by the assigned parameters, are generated from the respective channels. The tone color change control information is further applied to an interpolation circuit connected to the first and second channels. The interpolation circuit interpolates the generated tone signals in accordance with the tone color change control information. A result of the interpolation is outputted as a tone signal for a tone to be produced.

13 Claims, 4 Drawing Sheets

MIXING TYPE TONE SIGNAL GENERATION DEVICE EMPLOYING TWO CHANNELS GENERATING TONES BASED UPON DIFFERENT PARAMETER

BACKGROUND OF THE INVENTION

This invention relates to a multichannel tone signal generation device having individually and uniquely addressed channels and which is capable of generating a tone signal having a tone color controlled in accordance with tone color change control information such as key touch.

For generating a tone having a tone color controlled in accordance with key touch, it has been proposed to read out plural different waveshapes from a waveshape memory and interpose and synthesize these waveshapes at a ratio corresponding to the key touch (U.S. Pat. No. 4,231,276). In this case, waveshapes to be interpolated are not necessarily two channels but it is desirable to use more channels because a more complex tone color change control and hence a closer simulation of a desired tone color can thereby be realized. In the above mentioned U.S. Patent, for example, different waveshapes are generated in three channels, coefficient parameters are independently generated for respective channels and ratio of synthesis of waveshapes of corresponding coefficients is determined independently by these coefficient parameters.

In the above described prior art device, channels for the interpolation operation are provided in one-to-one correspondence for all waveshapes which are subjected to interpolation and, accordingly, multipliers for the interpolation operation and interpolation coefficient generation circuits of the same number as the waveshapes to be interpolated are required and this results in bulkiness in the circuit design.

SUMMARY OF THE INVENTION

It is, therefore, an object of the invention to provide a tone signal generation device which, in realizing a complex tone color change control by performing a tone synthesis operation such as an interpolation operation with respect to three or more tone signals of different waveshape characteristics in accordance with tone color change control information, is capable of realizing such control with a simplified circuit construction as compared with the prior art.

A tone signal generation device achieving the above described object of the invention comprises a first tone signal generation channel for generating a first tone signal having a waveshape characteristic corresponding to a parameter assigned to this channel, a second tone signal generation channel for generating a second tone signal having a waveshape characteristic corresponding to a parameter assigned to this channel, tone color change control information generation means for generating tone color change control information representing a manner of change of a tone color, waveshape characteristic parameter assigning means for selecting, in accordance with said tone color change control information, two parameters from among at least three parameters determining waveshape characteristics which are different from one another as first and second waveshape parameters and for assigning said first and second waveshape parameters to said first and second tone signal generation channels respectively, thereby causing said first and second tone signal generation channels to generate said first and second tone signals whose waveshape characteristics are determined by said first and second waveshape parameters respectively, and synthesizing means for synthesizing third musical tone signal on the basis of said first and second tone signals, said third tone signal being for said tone to be produced.

The waveshape characteristic parameter assigning means selects, in accordance with the tone color change control information, two parameters from among at least three parameters determining waveshape characteristics which are different from one another as the first and second waveshape parameters and assigns the selected first and second waveshape parameters to the first and second tone signal generation channels. The respective channels generate the first and second tone signals of different waveshape characteristics (i.e., tone color characteristics) corresponding to the assigned first and second waveshape parameters. The generated first and second tone signals are applied to the synthesizing means and the third musical tone signal whose tone color has been changed in accordance with the tone color change control information is synthesized on the basis of the first and second tone signals by the synthesizing means.

By selectively assigning two parameters from among at least three parameters determining waveshape characteristics to two tone signal generation channels in accordance with the tone color change control information, three or more different waveshapes can be subjected to synthesis by only employing two tone signal generation channels whereby a complex tone color change control closely simulating a desired tone color can be performed with a relatively simplified circuit construction.

The synthesizing means may comprise interpolation coefficient generation means for generating an interpolation coefficient and interpolation means for interpolating the first and second tone signals in accordance with the interpolation coefficient to output the result of the interpolation as the musical tone signal.

In a certain range of the values of the tone color change control information, two parameters corresponding to this range are selected and assigned to the first and second tone signal generation channels. As the value of the tone color change control information changes within this range, the interpolation coefficient changes in accordance with a predetermined interpolation curve and the interpolation is performed on the basis of this interpolation curve.

In another range of the values of the tone color change control information, two other parameters corresponding to this range are selected and assigned to the respective channels. As the value of the tone color change control information changes within this range, the interpolation coefficient changes in accordance with a predetermined interpolation curve and the interpolation is performed on the basis of this interpolation curve.

By selectively assigning two parameters from among at least three parameters determining waveshape characteristics to two tone signal generation channels in accordance with the tone color change control information, three or more different waveshapes can be subjected to interpolation by only employing two tone signal generation channels and corresponding interpolation circuits of two channels (each channel including a coefficient generation circuit and an operation means for interpolation) whereby a complex tone color change control closely simulates a desired tone color which stands in comparison with the system in which operation devices for interpolation are provided in parallel in one-to-one relation for all of the three or more waveshapes to be interpolated. Accordingly, according to this invention, a complex tone color change control closely simulating a desired tone color can be performed with an extremely simplified circuit construction as compared with the prior art device.

Preferred embodiments of the invention will now be described with reference to the accompanying drawings.

BRIEF DESCRIPTION OF THE DRAWINGS

In the accompanying drawings.

DESCRIPTION OF PREFERRED EMBODIMENTS

Figure 1:
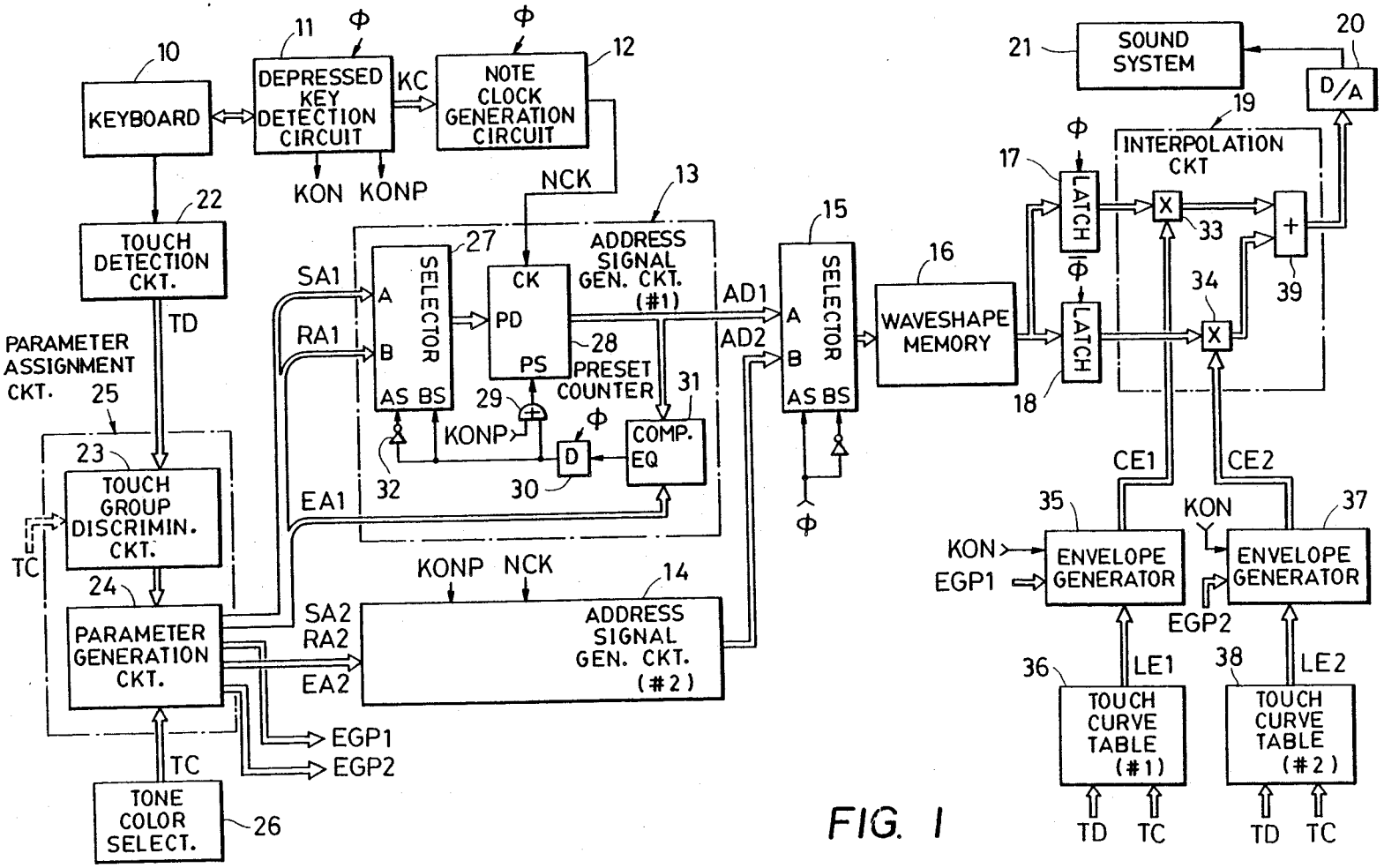
FIG. 1 is a block diagram showing an entire construction of an electronic musical instrument incorporating an embodiment of the invention.

Referring to FIG. 1, a depressed key detection circuit 11 detects a key depressed in a keyboard 10 and thereupon produces a key code KC and a key-on signal KON (a signal which maintains a state "1") identifying the depressed key and a key-on pulse KONP (a pulse which becomes "1" temporarily at the beginning of depression of the key). For convenience of description, the illustrated electronic musical instrument is assumed to be a monophonic musical instrument and, when plural keys have been depressed simultaneously, the key code KC, key-on signal KON and key-on pulse KONP are produced with respect to only one of the depressed keys in accordance with a predetermined single tone preferential selection order. Timings of outputting the signals KC, KON and KONP are synchronized with a predetermined clock pulse $\phi$.

A note clock generation circuit 12 generates, responsive to the key code KC supplied thereto, a note clock pulse NCK of a frequency corresponding to the tone pitch of a depressed key. This note clock pulse NCK is applied to address signal generation circuits 13 and 14 of two channels. Portions including these address signal generation circuits 13 and 14, a selector 15, a waveshape memory 16 and latch circuits 17 and 18 constitute two tone signal generation channels. Address signals AD1 and AD2 for accessing the waveshape memory are generated in parallel in the address signal generation circuits 13 and 14 provided in the respective channels. The selector 15 time-division-multiplexes the address signals AD1 and AD2 of the two channels so as to enable the single waveshape memory 16 to be used commonly for the two channels on a time shared basis. The latch circuits 17 and 18 are provided for converting tone signals of the two channels read out on a time shared basis from the waveshape memory 16 to parallel data. The tone signals of the two channels now converted to parallel data are synthesized by interpolation at a suitable ratio by an interpolation circuit 19 and thereafter are delivered to a sound system 21 through a digital-to-analog conversion circuit 20.

A touch detection circuit 22 detects a key touch on the basis of factors including, e.g., speed and force of depressing the key in the keyboard 10. In the following description, it is assumed, by way of example, that an initial touch corresponding to the speed of depression of the key is detected. The touch detection circuit 22 produces touch data TD representing the detected key touch. In this embodiment, this touch data TD is utilized as a tone color change control parameter.

A touch group discrimination circuit 23 and a parameter generation circuit 24 constitute a parameter assignment circuit 25. The parameter assignment circuit 25 selects, in response to the touch data TD, two waveshape characteristic parameters among three waveshape characteristic parameters which are different from one another and corresponding to three kinds of key touches (distinguished by fortissimo ff, mezzo forte mf and piano p) and assigns them to the above described two tone signal generation channels.

A parameter generation circuit 24 includes tables respectively storing the waveshape characteristic parameters corresponding to the three kinds of key touches ff, mf and p with respect to respective tone colors which can be selected by a tone color selection circuit 26. These tables also store data as to which of the two channels these three kinds of waveshape characteristic parameters should be assigned to in accordance with the range to which the touch data TD belongs.

The touch group discrimination circuit 23 classifies the touch data TD into two groups A and B within a predetermined range and produces touch group data depending upon which of the two groups (i.e., ranges) the touch data TD provided by the touch detection circuit 22 belongs to. The touch group data is applied to the parameter generation circuit 24 where it is used for accessing these tables. An example of the above described tables in the parameter generation circuit 24 is shown in the following Table 1: t,0110

The input 1 is a tone color kind designated by a tone color selection code TC. There are N kinds of tone colors ranging from tone color 1 to tone color N. The input 2 is touch group data provided by the touch group discrimination circuit 23. The group A corresponds to a strong touch and the touch group B to a weak touch. Among the outputs, SA1 - EGP1 are parameters for the first channel and SA2 - EPG2 are parameters for the second channel. Among the parameters produced, SA represents start address data, RA repeat address data and EA end address data, respectively designating addresses of waveshape data stored in the waveshape memory 16. EGP is an envelope parameter consisting of parameter data of attack rate AR, decay rate DR, sustain level SL and release rate RR. The designators ff, mf and p represent, as described above, key touch strength and indicate that contents of these parameters correspond to the respective key touch strength.

If, in Table 1, the touch data TD belongs to the strong touch group A when the tone color 1 has been selected, the waveshape address data SA - EA and envelope parameter data AR - RR corresponding to fortissimo ff are produced as the waveshape characteristic parameters SA1 - EA1 and EGP1 for the first channel and the waveshape address data SA - EA and envelope parameter data AR - RR corresponding to mezzo forte mf are produced as the waveshape characteristic parameters SA2 - EA2 and EGP2 for the second channel.

If the touch data TD belongs to the weak group B, data SA - EA and AR - RR corresponding to piano p are produced as the parameters SA1 - EA1 and EGP1 for the first channel and data SA - EA and AR - RR corresponding to mezzo forte mf are produced as the parameters SA2 - EA2 and EGP2 for the second channel. With respect to other tone colors also, parameters for the first and second channels corresponding to the touch groups A and B are stored.

Figure 2:
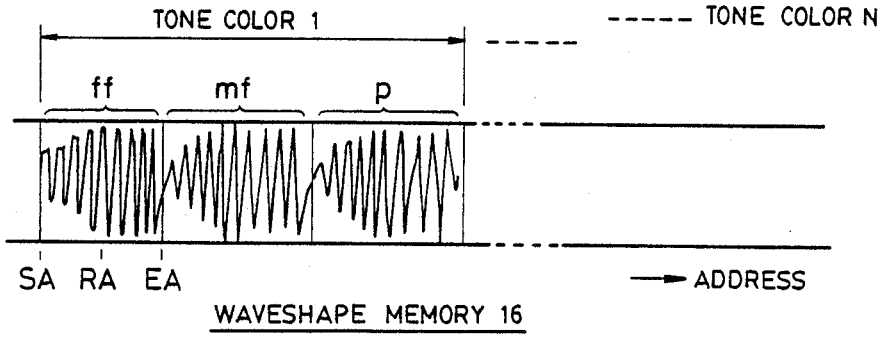
FIG. 2 is a diagram showing an example of a memory format in a waveshape memory shown in FIG. 1.

An example of a memory format of tone waveshapes in the waveshape memory 16 is shown in FIG. 2. In this format, waveshapes from the tone color 1 through the tone color N are sequentially stored. As to one tone color, waveshapes corresponding to tone color characteristics of three different kinds, specifically, ff, mf and p, are sequentially stored. As to a waveshape of one tone color characteristic (e.g., ff), data of waveshape of plural periods from an attack portion to a sustain portion of a tone is stored in a predetermined coded form (e.g., pulse code modulation: PCM). In this data, an address storing first sample point data of the waveshape of the attack portion is start address (SA) and an address storing last sample point data of the waveshape of plural periods corresponding to the particular characteristic is end address (EA). A first address of the repeatedly read out portion is repeat address (RA). The start address data SA, repeat address data RA and end address data EA generated by the parameter generation circuit 24 respectively designate, in an absolute address, the start address, repeat address and end address of a waveshape to be read out. As is known, reading of such waveshape of plural periods is performed in such a manner that a waveshape from the start address (SA) to the end address (EA) is repeatedly read out. For convenience of description, the memory format in FIG. 2 is shown in such a manner that a waveshape having an amplitude envelope is stored in the waveshape memory 16. In actuality, however, waveshape data in which the amplitude level has been standardized at a certain level is stored in the waveshape memory 16 and, after this waveshape data has been read out, a suitable amplitude envelope is imparted to the waveshape data read out.

The waveshape address data SA1 - EA1 for the first channel generated by the parameter generation circuit 24, i.e., the address data SA - EA of the waveshape characteristics assigned to the first channel, are supplied to the address generation circuit 13 for the first channel. The data SA2 - EA2 for the second channel, i.e., the address data SA2 - EA2 of the waveshape characteristics assigned to the second channel, are supplied to the address generation circuit 14 for the second channel. The internal construction of the address generation circuit 13 only is illustrated but the other address generation circuit 14 is of the same internal construction.

The address generation circuit 13 will now be described. The start address data SA1 and the repeat address data RA1 are respectively applied to A and B inputs of a selector 27 and an output of this selector 27 is applied to a preset data input PD of a preset counter 28. To a preset control input PS of the preset counter 28 is applied the key-on pulse KONP or an output of a delay flip-flop 30 through an OR gate 29. To a count input CK of the counter 28 is applied the note clock pulse NCK. A count output of the preset counter 28 and the end address data EA1 are supplied to a comparator 31 and, when the two values coincide with each other, a signal "1" is produced. This comparison output signal is delayed by the delay flip-flop 30 by one period of the clock pulse and thereafter is supplied to the OR gate 29 and a B selection control input BS of the selector 27 and also to an A selection control input AS of the selector 27 after being inverted by an inverter 32. The count output of the preset counter 28 is supplied to an A input of the selector 15 as the address signal AD1 for reading out the waveshape for the first channel.

Normally, the output signal of the delay flip-flop 30 is "0" and the selector 27 selects the start address data SA1 applied to the A input. Upon depression of a key, generation of the note clock pulse NCK corresponding to the note frequency of the depressed key is started. Simultaneously, the start address data SA1 is preset in the counter 28 in response to the key-on pulse KONP generated at the beginning of depression of the key (the preset operation is performed in synchronism with application of the note clock pulse NCK). Accordingly, the preset counter 28 starts counting the note clock pulse NCK with the start address data SA1 constituting the initial value whereby the value of the address signal AD1 gradually increases at a rate corresponding to the tone pitch of the depressed key with the start address data SA1 constituting the initial value. When the value of the address signal AD1 has finally become the same value as the end address data EA1, the output signal of the comparator 31 becomes "1", the selector 27 selects the repeat address data RA1 of the B input and this repeat address data is preset in the counter 28 in synchronization with arrival of a next note clock pulse NCK. The value of the address signal AD1 thereby is restored to RA1 and increase corresponding to the note clock pulse NCK is resumed therefrom. Subsequently, each time the value of AD1 has reached the end address data EA1, AD1 is restored to the repeat address data RA1 and this increase is repeated. By such change in the address signal AD1, the above described waveshape reading, i.e., reading the waveshape from the start address (SA) to the end address (EA) once and then reading the waveshape from the repeat address (RA) to the end address (EA) repeatedly.

The other address generation circuit 14 likewise generates the address signal AD2 in response to the address parameters SA2 - EA2 and the note clock pulse NCK and supplies this address signal to the B input of the selector 15.

The selector 15 selects the address signal AD1 of the A input when the clock pulse is "1" and selects the address signal AD2 of the B input when the clock pulse is "0". It is assumed that the duty cycle of the clock pulse is ½. In this manner, the time division multiplexed address signals AD1 and AD2 for the two channels are applied to the waveshape memory 16 and, in response thereto, waveshape data (tone signals) for the two channels are read out on a time shared basis. The latch circuit 17 latches the output read out from the waveshape memory 16 (i.e., waveshape sampled value of the tone signal for the first channel read out in accordance with the data AD1) when the clock pulse is "1". The latch circuit 18 latches the output read out from the waveshape memory 16 (i.e., waveshape sampled value of the tone signal for the second channel read out in accordance with the data AD2) when the clock pulse is "0".

The tone signal sampled value data for the first channel latched by the latch circuit 17 is applied to a multiplier 33 of the interpolation circuit 19 and the tone signal sampled value data for the second channel latched by the latch circuit 18 is applied to a multiplier 34 of the interpolation circuit 19. To the other input of the multiplier 33 is applied a first coefficient CE1 for interpolation from a circuit consisting of an envelope generator 35 and a touch curve table 36. To the other input of the multiplier 34 is applied a second coefficient CE2 for interpolation from a circuit consisting of an envelope generator 37 and a touch curve table 38.

The touch curve tables 36 and 38 generate the coefficients LE1 and LE2 corresponding to the touch data TD. The envelope generators 35 and 37 add envelope waveshape levels to these coefficients to produce the coefficients CE1 and CE2 of envelope shapes corresponding to the key touch.

Figure 3A:
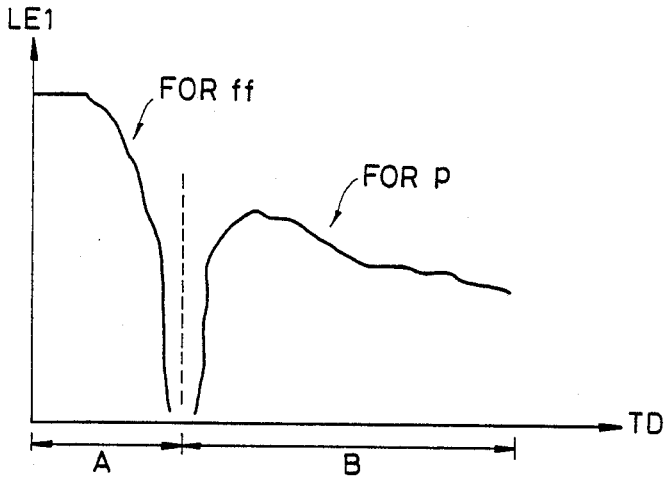
FIGS. 3*a* and 3*b* are graphs showing examples of interpolation function curves stored in touch curve tables of respective channels in FIG. 1.
Figure 3B:
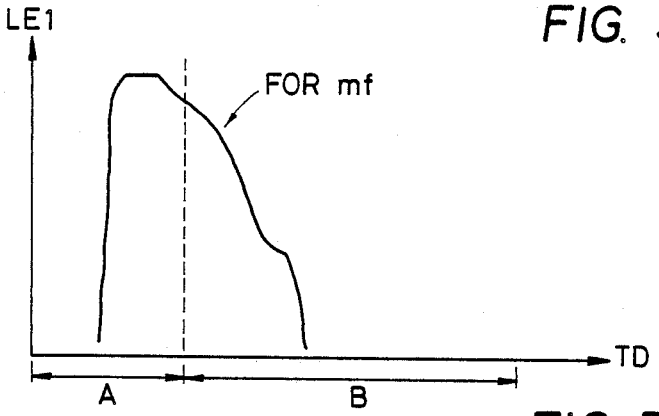
Figure 3C:
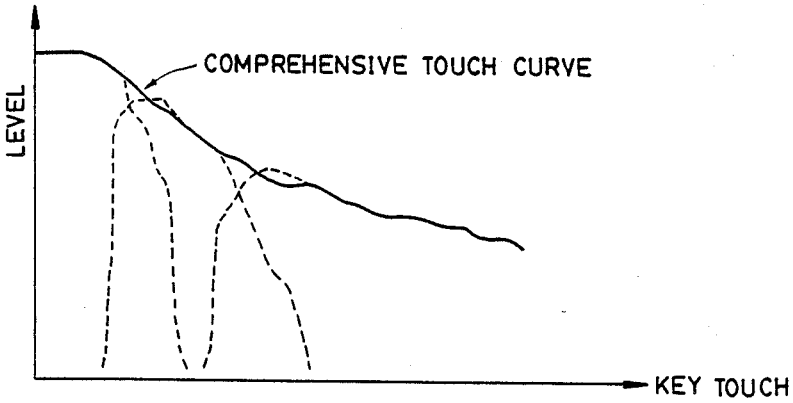
FIG. 3*c* is a graph showing a comprehensive touch curve characteristic which is a result of synthesizing the functions of FIGS. 3*a* and 3*b;*

The touch tables 36 and 38 sequentially store proper interpolation function curves corresponding to the touch groups A and B in continuous address regions using the touch data TD as address input information. For example, contents of storage in the touch curve table 36 for the first channel are as shown in FIG. 3(*a*). The table 36 stores an interpolation function curve corresponding to fortissimo ff in the address range of the touch data TD for the touch group A and stores an interpolation function curve corresponding to piano p in the address range of the touch data TD for the touch group B. Contents of storage of the touch curve table 38 for the second channel are as shown in FIG. 3 (*b*). The table 38 stores an interpolation function curve corresponding to mezzo forte mf in the address range of the touch data TD for the touch group A and stores an interpolation function curve corresponding to mezzo forte mf also in the address range of the touch data TD for the touch group B. In the tables 36 and 38, the coefficients LE1 and LE2 are read out from corresponding interpolation function curves by using the touch data TD as the address signal.

The interpolation function curves shown in FIGS. 3 (*a*) and (*b*) have taken change in the tone level according to the key touch into account. A comprehensive touch curve characteristic formed by synthesizing the two curves is as shown in FIG. 3 (*c*). Each tone color has its own table and the table is selected in accordance with the tone color selection code TC.

As will be apparent from FIG. 3(*a*), interpolation function curves for different waveshape characteristics (ff and p) can be respectively stored in continuous address regions in a common table. Accordingly, it is not necessary to provide separate tables for the respective waveshape characteristics so that construction can be simplified. It will be apparent from this that touch curve tables for two channels are sufficient even if the number of the waveshape characteristics to be interpolated has increased to a large one.

To the envelope generators 35 and 37 are applied the envelope parameters EGP1 and EGP2 for the respective channels generated by the parameter generation circuit, the interpolation coefficients LE1 and LE2 corresponding to the touch data TD and the key-on signal KON. The characteristics of the envelope shapes to be generated are determined in accordance with the values of the parameters AR - RR contained in the envelope parameters EGP1 and EGP2.

Figure 4A:
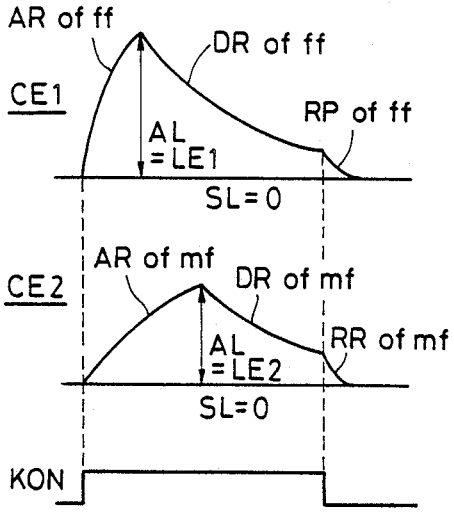
FIGS. 4*a* and 4*b* are diagrams showing examples of interpolation coefficients in the form of an envelope shape generated by an envelope generator in FIG. 1.
Figure 4B:
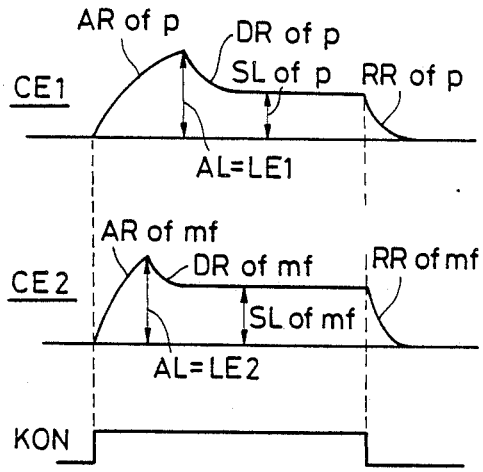

FIG. 4 shows an example of the envelope shape formed in the above manner. FIG. 4(*a*) shows an example of an envelope shape when the sustain level SL is 0, i.e., a percussive type envelope and FIG. 4(*b*) shows an example of an envelope shape when the sustain level SL is a value other than 0, i.e., a sustain tone type envelope. In the case of FIG. 4(*a*), the envelope shape of the first channel (coefficient CE1) is established by the parameter of fortissimo ff and the envelope shape of the second channel (coefficient CE2) is established by the parameter of mezzo forte mf. In the case of FIG. 4(*b*), CE1 is established by the parameter of piano p. The envelope shapes rise to an attack level AL at an attack rate AR in response to rising of the key-on signal KON, decay to a sustain level SL at a decay rate DR and then decay to level 0 when the key-on signal KON has becomes "0". As the attack level AL, the coefficients LE1 and LE2 generated in response to the touch data TD are used. Accordingly, peak levels of the interpolation coefficients CE1 and CE2 of the envelope shape type are controlled in response to the key touch. In the interpolation circuit 19, therefore, interpolation according to the interpolation function curves (e.g., FIGS. 3(*a*) and 3(*b*)) stored in the touch curve tables 36 and 38 can be realized.

In the interpolation circuit 19, the tone signals controlled in their level in accordance with the coefficients CE1 and CE2 by the multipliers 33 and 34 are applied to an adder 39 and synthesized therein. The tone signal thus interpolated and synthesized is supplied from the adder 39 to the digital-to-analog converter 20.

Figure 5:
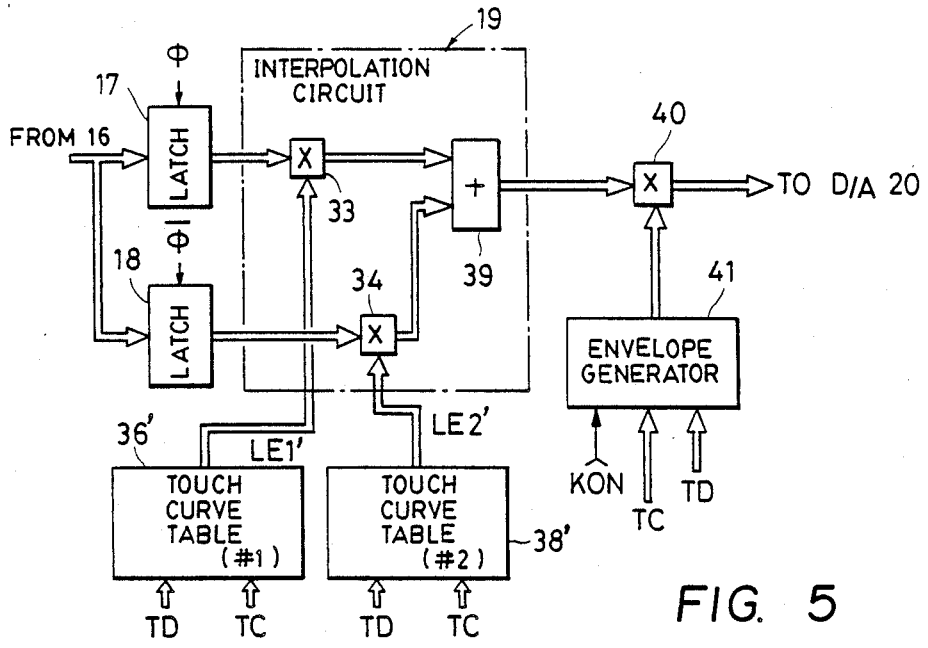
FIG. 5 is a block diagram showing a modified embodiment of FIG. 1.

In the embodiment of FIG. 1, the interpolation function curves stored in the touch curve tables 36 and 38 are formed by taking change in the tone level corresponding to the key touch into account. The attack level of the envelope shape signal is controlled by the coefficients LE1 and LE2 read out from these curves and the interpolation circuit 19 performs the interpolation operation (i.e., tone color change control) of the tone signals for the two channels according to the key touch and also the tone level control according to the key touch. Alternatively, the tone color control and the tone level control according to the key touch may be performed separately. FIG. 5 shows an embodiment of such separate controls.

Figure 6A:
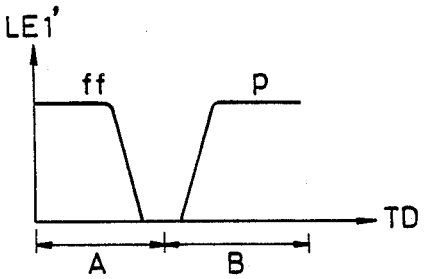
FIGS. 6*a* and 6*b* are graphs showing examples of interpolation function curves stored in a touch curve table shown in FIG. 5.
Figure 6B:
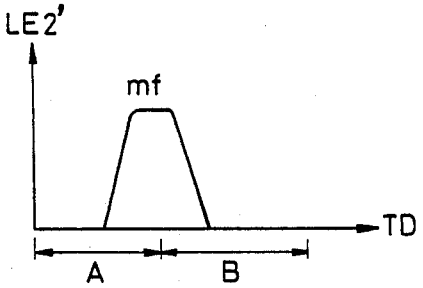

Touch curve tables 36' and 38' for the respective channels store curves corresponding only to interpolation functions used for the tone color control, disregarding the tone level change according to the key touch. In this case also, interpolation function curves proper to address ranges of the respective touch groups are stored in the same manner as in the previously described embodiment (FIGS. 6(*a*) and 6(*b*)). Coefficients LE1' and LE2' read out from the respective tables 36' and 38' are applied directly to the multipliers 33 and 34 of the interpolation circuit 19. The envelope generator 41 is provided for one channel only and generates an envelope shape signal having an ADSR characteristic corresponding to the tone color selection code TC and the touch data TD in response to the key-on signal KON. The tone signal interpolated and synthesized by the interpolation circuit 19 is applied to the multiplier 40 in which it is multiplied by the envelope shape signal supplied from the envelope generator 41. In this case, the parameter generation circuit 24 has only to store the address data SA, RA and EA shown in Table 1 and the envelope generator 41 has a memory for storing the envelope parameters AR, DR, SL and RR for each tone color and for each key touch strength.

Figure 7A:
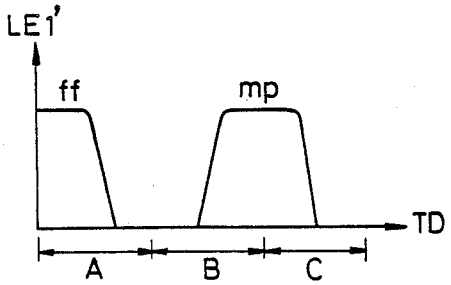
FIGS. 7*a* and 7*b* are graphs showing examples of interpolation functions stored in touch curve tables corresponding to the first and second channels when waveshape characteristics to be interpolated are of four kinds: ff, mf, mp and pp.
Figure 7B:
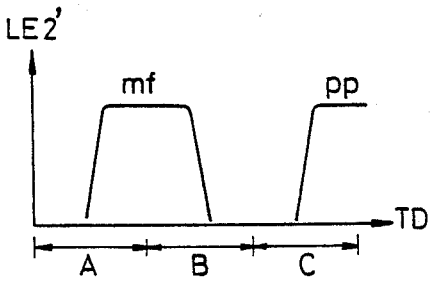

In the above described embodiments, two waveshapes among waveshapes corresponding to three kinds of key touches ff, mf and p are selected and assigned to two channels for interpolation. Alternatively, waveshapes to be assigned to the two channels may be waveshapes of four or more kinds. In the case of waveshapes of four kinds, for example, waveshape data corresponding to four kinds of key touch strengths, i.e., fortissimo ff, mezzo forte mf, mezzo piano mp and pianissimo pp, are stored in the waveshape memory 16. Touch data groups of the touch data TD in the touch group discrimination circuit 23 are classified into three groups of A, B and C and the parameter generation circuit 24 prestores in its table parameters to be assigned to the first and second channels in correspondence to these three groups. Waveshape characteristics of the parameters to be assigned are ff for the first channel and mf for the second channel in the case of the strong touch group A, mp for the first channel, mf for the second channel in the case of the middle touch group B and mp for the first channel and pp for the second channel in the case of the weak touch group C. Accordingly, interpolation function curves stored in the touch group tables 36 and 38 (or 36' and 38') of the respective channels are formed as shown in FIG. 7(*a*) for the first channel and as shown in FIG. 7(*b*) for the second channel. An embodiment in which there are five or more waveshape characteristics to be assigned will be readily conceived from the above embodiments.

The tone selection code TC may be applied to the touch group discrimination circuit 23 as shown by a dotted line and the ranges of the touch groups A and B are switched in accordance with the tone color. In this case, an arrangement will be made so that the address ranges (i.e., resolution of interpolation) of interpolation function curves corresponding to the respective touch groups A and B in the touch curve tables 36, 38, 36' and 38' are switched in accordance with the tone color kind.

In FIG. 1, the address generation circuits 13 and 14 are provided in parallel with each other for the respective channels. Alternatively, a common hardware circuit may be used commonly on a time shared basis.

The waveshape data stored in the waveshape memory 16 is not limited to data which, as was previously described, is formed by standardizing the envelope level at a certain level but it may be data in which an envelope characteristic such as attack or decay has been imparted. In this case, the envelope waveshape signal generated by the envelope generator should maintain a constant level during depression of the key and exhibit a release envelope characteristic after release of the key.

The coding method for storing waveshape data in the waveshape memory is not limited to the PCM system as described before but it may be another suitable data compression system such as DPCM (difference PCM), ADPCM (adaptive DPCM), DM (delta modulation), ADM and LPC.

The waveshape to be stored in the waveshape memory is not limited to a waveshape of plural periods but may be a waveshape of one period or half period. Instead of reading the waveshape repeatedly, a full waveshape from start of sounding of a tone to the end thereof may be stored. Instead of storing in the memory all waveshape information at respective sample points of a waveshape to be stored, waveshape information of intermittent sample points may be stored and waveshape information at intermediate sample points may be calculated by the interpolation operation. For example, as disclosed by U.S. Pat. No. 4,633,749, a waveshape of a tone from its rising to falling is divided into plural frames, typical waveshape data for a waveshape of one period or two periods only is stored for each frame and waveshape data for respective frames may be repeatedly read, waveshape data for each frame being sequentially switched. If necessary, in switching the waveshape, smoothly changing waveshape data may be formed by connecting a preceding waveshape and a next new waveshape by interpolation operation.

Generation of a tone signal in each channel is not limited to the above described waveshape readout system but another system such as a harmonic synthesis system or FM or AM modulation operation system may be employed. In this case, parameters generated by the parameter assignment circuit determine desired waveshape characteristics in accordance with the tone signal generation system.

In the above described embodiments, the address signal for reading a waveshape is formed by counting the note clock pulse. The address signal however may be formed by accumulating, adding or subtracting the frequency number corresponding to the tone pitch of a depressed key. Operations for generating the address signal or parameters may be performed by a software process instead of a hardware circuit.

In the above described embodiments, a waveshape which is common to respective tone pitches is read out upon changing its reading rate in accordance with the tone pitch. Alternatively, waveshapes which differ depending upon key or tone range may be stored in and read out from the waveshape memory.

In the above described embodiments, key touch data, particularly initial touch data, is employed as the tone color change control parameter. Alternatively, other data such as after touch data corresponding to the force of depressing a key, key scaling data corresponding to the tone pitch or tone range of a tone to be generated and output data of a suitable operation knob such as a brilliance operation knob which can be operated by a performer may be used individually or in combination as the tone color change control parameter.

The present invention is applicable not only to a monophonic type musical instrument but also to a polyphonic type musical instrument. Further, the invention is applicable not only to a keyboard type electronic musical instrument but also to other electronic musical instruments such, for example, as an independent tone source module and a rhythm tone source device.

What is claimed is:

1. A tone signal generation device comprising:

a first tone signal generation channel for generating a first tone signal having a wavelength characteristic corresponding to a parameter assigned to said first tone signal generation channel;

a second tone signal generation channel for generating a second tone signal having a waveshape characteristic corresponding to a parameter assigned to said second tone signal generation channel;

tone color change control information generation means for generating tone color change control information representing a manner of change of a tone color of a tone to be produced;

waveshape characteristic parameter assigning means for selecting, in accordance with said tone color change control information, two parameters from among at least three parameters determining waveshape characteristics which are different from one another as first and second waveshape parameters and for assigning said first and second waveshape parameters to said first and second tone signal generation channels respectively, thereby causing said first and second tone signal generation channels to generate said first and second tone signals whose waveshape characteristics are determined by said first and second waveshape parameters respectively; and synthesizing means for synthesizing a third musical tone signal using said first and second tone signals, said third tone signal being for said tone to be produced.

2. A tone signal generation device as defined in claim 1 wherein said synthesizing means comprises interpolation coefficient generation means for generating an interpolation coefficient; and interpolation means for interpolating said first and second tone signals in accordance with said interpolation coefficient to output a result of the interpolation as said third tone signal.

3. A tone signal generation device as defined in claim 2 wherein said interpolation coefficient is generated in accordance with said tone color change control information.

4. A tone signal generation device as defined in claim 2 wherein said coefficient generation means comprises first and second coefficient generation means for generating first and second coefficients as said interpolation coefficient; and said interpolation means comprises first multiplying means for multiplying said first tone signal with said first interpolation coefficient to output first multiplication result, second multiplying means for multiplying said second tone signal with said second interpolation coefficient to output second multiplication result and mixing means for mixing said first and second multiplication results to output said third tone signal.

5. A tone signal generation device as defined in claim 1 wherein said waveshape characteristic parameter assigning means selects said first and second waveshape parameters in accordance with a range, to which the value of said tone color change control information belongs, among predetermined plural ranges each being defined by a scope of values based on maximum and minimum values.

6. A tone signal generation device as defined in claim 5, wherein said synthesizing means comprises interpolation coefficient generation means for generating an interpolation coefficient and interpolation means for interpolating said first and second tone signals in accordance with said interpolation coefficient to output a result of the interpolation as said third tone signal;

and wherein said interpolation coefficient generation means comprises storing means for storing plural interpolation coefficients corresponding to said predetermined plural ranges respectively and generates one of said plural interpolation coefficients corresponding to said tone color change control information from among said predetermined plural ranges as said interpolation coefficient.

7. A tone signal generation device as defined in claim 6 wherein said storing means stores said plural interpolation coefficients whose values are determined by said value of said tone color change control information.

8. A tone signal generation device as defined in claim 1 which further comprises plural keys each designating a pitch of said tone to be produced and wherein said tone color change control information generation means generates, as said tone color change control information, touch data representing a degree of depression of a depressed key among said keys.

9. A tone signal generation device as defined in claim 1 wherein said tone color change control information generation means generates, as said tone color change control information, key scaling data which is data concerning the pitch of a depressed key.

10. A tone signal generation device as defined in claim 1 wherein said tone color change control information generation means comprises a tone color change control operation element, said tone color change control information being generated on the basis of operation of said tone color change control operation element.

11. A tone signal generation device as defined in claim 1 wherein said first and second tone signals have a common fundamental frequency.

12. A tone signal generation device as defined in claim 1 which further comprises a keyboard having keys for designating pitches of tones to be generated and said first and second tone signal generation channels generate said first and second tone signals of pitches corresponding to a depressed key in said keyboard.

13. A tone signal generation device as defined in claim 1 wherein said tone signal generation channels are capable of generating selected tones among plural tone waveshapes which are different from one another and tone waveshapes to be generated are selected in accordance with the assigned parameters.

* * * * *